US008414258B2

(12) United States Patent
Burdgick et al.

(10) Patent No.: US 8,414,258 B2
(45) Date of Patent: Apr. 9, 2013

(54) SUPPORT BAR FOR TURBINE DIAPHRAGM THAT FACILITATES REDUCED MAINTENANCE CYCLE TIME AND COST

(75) Inventors: Steven Sebastian Burdgick, Schenectady, NY (US); James Peter Anderson, Clifton Park, NY (US); Christopher Donald Porter, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 811 days.

(21) Appl. No.: 12/617,946

(22) Filed: Nov. 13, 2009

(65) Prior Publication Data

US 2011/0116919 A1 May 19, 2011

(51) Int. Cl.
*F01D 25/28* (2006.01)

(52) U.S. Cl.
USPC ..... 415/209.2

(58) Field of Classification Search ..... 415/108, 415/209.2, 126, 213.1, 232, 209.3, 209.4, 415/210.1, 214.1
See application file for complete search history.

(56) References Cited

U.S. PATENT DOCUMENTS

| | | | | |
|---|---|---|---|---|
| 1,352,278 | A * | 9/1920 | Junggren | 415/135 |
| 3,861,827 | A * | 1/1975 | Peabody et al. | 415/209.2 |
| 4,204,803 | A | 5/1980 | Leger et al. | |
| 6,325,596 | B1 | 12/2001 | Tomko | |
| 6,547,523 | B2 | 4/2003 | Nelligan | |
| 6,695,316 | B2 * | 2/2004 | Popa et al. | 277/411 |
| 7,329,098 | B2 | 2/2008 | Burdgick | |
| 7,458,770 | B2 | 12/2008 | Russo et al. | |
| 7,682,131 | B2 * | 3/2010 | Legare et al. | 415/208.2 |
| 2008/0286097 | A1 | 11/2008 | Chevrette et al. | |
| 2008/0317591 | A1 * | 12/2008 | Golinkin et al. | 415/213.1 |

FOREIGN PATENT DOCUMENTS

JP 58106103 A * 6/1983

* cited by examiner

*Primary Examiner* — Nathaniel Wiehe
*Assistant Examiner* — Ryan Ellis
(74) *Attorney, Agent, or Firm* — Hoffman Warnick LLC; Ernest G. Cusick

(57) ABSTRACT

A support bar for a turbine diaphragm that facilitates reduced maintenance cycle time and cost is provided. In one aspect, the support bar is secured to the turbine diaphragm vertically rather than horizontally, allowing access to remove a lower diaphragm half without having to remove the rotor for maintenance.

18 Claims, 7 Drawing Sheets

SUPPORT BAR FOR TURBINE DIAPHRAGM THAT FACILITATES REDUCED MAINTENANCE CYCLE TIME AND COST

BACKGROUND OF THE INVENTION

The present invention relates generally to a steam turbine and more particularly to a support bar design that supports a steam turbine diaphragm while housed in a steam turbine casing and that facilitates reduced maintenance cycle time and cost of the steam turbine.

A typical steam turbine generally includes static nozzle segments that direct steam flow into rotating buckets that are connected to a rotor. Each row of buckets and their corresponding nozzles is known as a turbine stage. The nozzle construction is typically called a turbine diaphragm stage. A turbine diaphragm is assembled into two halves (i.e., an upper half and lower half) around a rotor, creating a horizontal joint. The turbine diaphragm is supported vertically by one of several possible approaches at the horizontal joint. One approach is to use a support bar to vertically support the turbine diaphragm while it is housed in a turbine casing, which also is assembled into halves separated by a midline. In this approach, there are typically two support bars that are attached to the bottom half of the turbine diaphragm near the horizontal joint by several horizontal extending bolts.

Current support bar designs have been found to hinder the maintenance cycle time and cost of a steam turbine because these designs require that the rotor and diaphragm lower half be removed in order to perform vertical diaphragm alignment or maintenance on the turbine diaphragm. As a result, a typical turbine diaphragm maintenance process may take several shifts or days to complete. In such a turbine diaphragm maintenance process, an upper casing from the turbine assembly is first removed. Then, the upper half of the turbine diaphragm is removed. The support bars cannot readily be removed from the turbine diaphragm without removing the diaphragms from the turbine casing because there is not enough clearance to get to the horizontal bolts that are used to horizontally secure the support bars to the lower half of the diaphragm. The fact that the support bars cannot be removed from the diaphragms while in the turbine casing means that the adjustment shim blocks also cannot be removed, therefore, preventing vertical adjustment of the diaphragm within the turbine casing. Thus, the rotor needs to be removed to allow access to the shim block for vertical diaphragm adjustment.

BRIEF DESCRIPTION OF THE INVENTION

The turbine diaphragm maintenance cycle time would be faster and require less man hours if the rotor and diaphragm lower half did not have to be removed to be able to vertically adjust the diaphragm. It may also be desirable to remove the lower half of the diaphragm from the turbine casing without having to remove the rotor during the turbine diaphragm maintenance process or during vertical alignment of the diaphragm.

In one aspect of the present invention, a support bar for a turbine diaphragm is provided. The support bar comprises a vertical body portion having at least one boss extending substantially perpendicular from the vertical body portion. The at least one boss is adapted to mate in a slot formed in the turbine diaphragm. The at least one boss has at least one opening formed therein that extends vertically through the at least one boss. The at least one opening is adapted to receive at least one fastener that extends through the at least one boss to secure the vertical body portion and at the least one boss vertically with the turbine diaphragm.

In another aspect of the present invention, a support bar arrangement for a turbine diaphragm in a turbine casing is provided. The turbine diaphragm has an upper diaphragm half and a lower diaphragm half with at least one slot formed therein. The upper diaphragm half and lower diaphragm half are secured together along a horizontal joint. The turbine casing has an upper casing half and a lower casing half has a shoulder formed therein. The upper casing half and lower casing half are secured together along a midline. In this aspect, the support arrangement comprises a shim block having a lower surface and a top surface. The lower surface of the shim block is seated on the shoulder of the lower casing half. A support bar comprising a vertical body portion having a lower surface seated on the top surface of the shim block and at least one boss extending substantially perpendicular from the vertical body portion. The at least one boss is adapted to mate in the at least one slot formed in the lower diaphragm half. The at least one boss has at least one support bar opening formed therein. At least one support bar fastener extends through the at least one support bar opening in the at least one boss to secure the support bar vertically with the lower diaphragm half.

In a third aspect of the present invention, a steam turbine is disclosed. In this aspect of the present invention, the steam turbine comprises a turbine diaphragm having an upper diaphragm half and a lower diaphragm half with at least one slot formed therein. The upper diaphragm half and lower diaphragm half are secured together along a horizontal joint. A turbine casing houses the turbine diaphragm. The turbine casing has an upper casing half and a lower casing half having a shoulder formed therein. The upper casing half and lower casing half are secured together along a midline. A support bar supports the turbine diaphragm while housed in the turbine casing. The support bar comprises a vertical body portion having at least one boss extending substantially perpendicular from the vertical body portion. The at least one boss is adapted to mate in the at least one slot formed in the lower diaphragm half. The at least one boss has at least one support bar opening formed therein. At least one support bar fastener extends through the support bar opening in the at least one boss to secure the support bar vertically with the lower diaphragm half.

DETAILED DESCRIPTION OF THE INVENTION

Various embodiments of the present invention are directed to a support bar arrangement that is secured to the turbine diaphragm (hereinafter "diaphragm") vertically rather than horizontally. In particular, the support bar arrangement uses at least one fastener, such as for example, a bolt that extends vertically with respect to the diaphragm. Using a vertically extending fastener that secures the support bar arrangement to the diaphragm makes it much easier to have access to the fastener without having to remove the entire diaphragm. Therefore, once the fastener is removed, the diaphragm can be slightly lifted, and the support bar can then be pried off of the diaphragm into a machined pocket in the turbine shell or casing (hereinafter "casing"). Once one support bar is removed, then a shim block that may be used to adjust the vertical position of the diaphragm may be removed for machining to adjust the vertical position of the diaphragm. Additionally, it may be possible to roll out the lower diaphragm half from the casing around the rotor. Either method avoids the need to completely remove the rotor, which is the case with current support bar arrangements. Because it is no longer necessary to completely remove the rotor, the support bar arrangement of the various embodiments of the present invention facilitate technical effects such as reduced cycle time and cost for diaphragm maintenance. In addition, there is a benefit to an installation or maintenance team in that the lower half diaphragms do not have to be laid down in the power plant during vertical adjustment. This is a benefit because in most power plants there is very limited "lay-down" space for turbine hardware.

Figure 1:
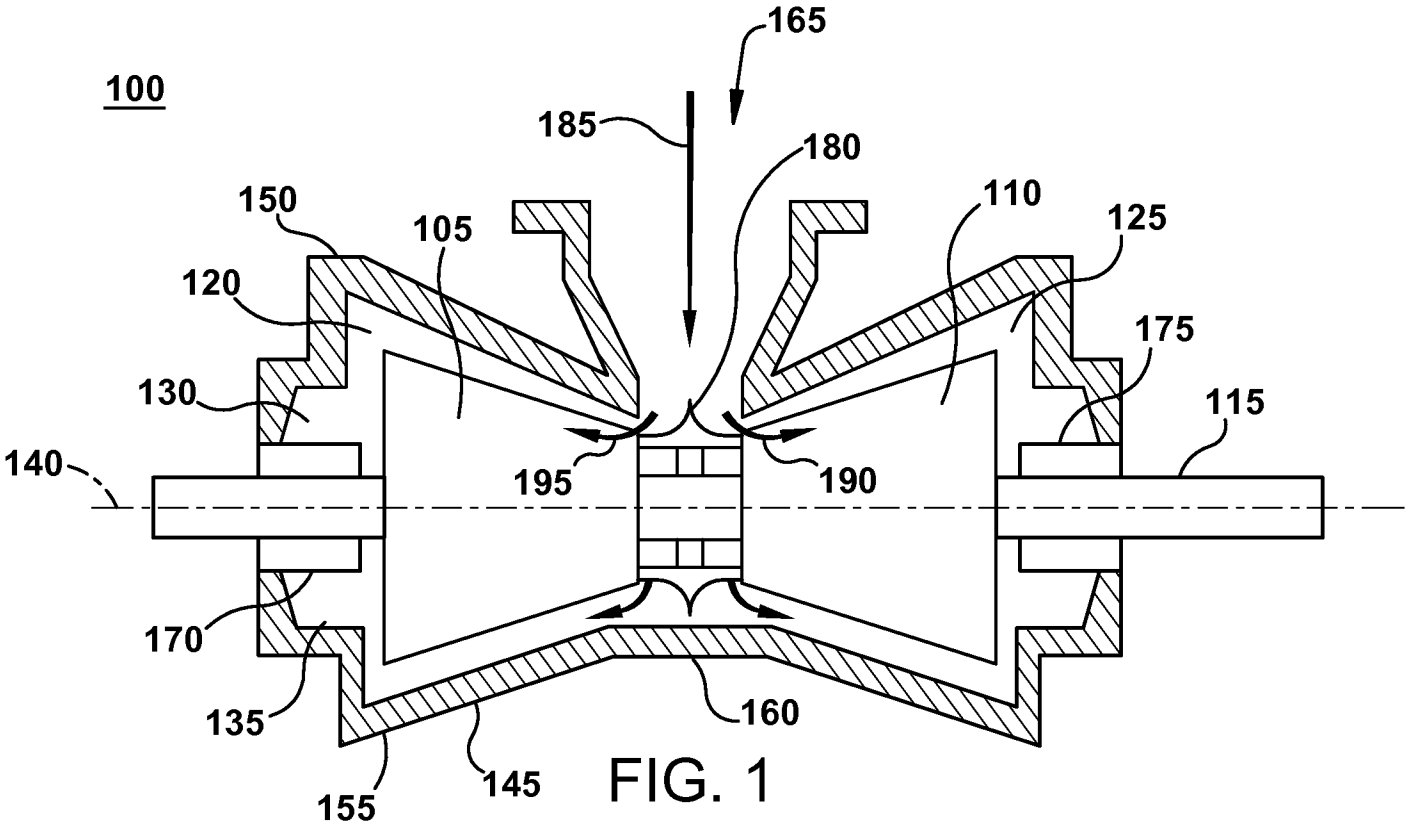
FIG. 1 is a schematic diagram of an example of an opposed-flow steam turbine in which various embodiments of the present invention may be implemented.

Referring to the drawings, FIG. 1 shows a schematic diagram of an example of an opposed-flow steam turbine 100 in which various embodiments of the present invention may be implemented. Turbine 100 includes a first low pressure (LP) section 105 and a second LP section 110. A rotor shaft 115 extends through LP sections 105 and 110. LP sections 105 and 110 are surrounded by diaphragm assemblies 120 and 125, respectively. The diaphragm assemblies 120 and 125 have an upper diaphragm half 130 and a lower diaphragm half 135 that are secured together along a horizontal joint that is shown in FIG. 1 as a horizontal split line 140. A single outer casing 145 houses the diaphragm assemblies 120 and 125. The casing 145 is divided along horizontal split line 140 and axially into upper and lower half sections 150 and 155, respectively, and spans both LP sections 105 and 110. A central section 160 of casing 145 includes a low pressure steam inlet 165. Within outer casing 145, LP sections 105 and 110 are arranged in a single bearing span supported by journal bearings 170 and 175. A flow splitter 180 extends between LP sections 105 and 110.

During operation, low pressure steam inlet 165 receives low pressure/intermediate temperature steam 185 from a source, such as, but not limited to, a high pressure (HP) turbine or an intermediate pressure (IP) turbine through a cross-over pipe (not shown). Steam 185 is channeled through inlet 165 wherein flow splitter 180 splits the steam flow into two opposite flow paths 190 and 195. More specifically, in the exemplary embodiment, steam 185 is routed through LP sections 105 and 110 wherein work is extracted from the steam to rotate rotor shaft 115. The steam exits LP sections 105 and 110 where it is routed for further processing (e.g., to a condenser).

It should be noted that although FIG. 1 illustrates an opposed-flow, LP turbine, it will be appreciated by one of ordinary skill in the art, that the support bar arrangement of the embodiments of the present invention is not limited to being used only with LP turbines and can be used with any opposed-flow turbine including, but not limited to, IP turbines and/or HP turbines. In addition, the support bar arrangement of the embodiments of the present invention is not limited to only being used with opposed-flow turbines, but rather may also be used with other turbines (e.g., single flow steam turbines).

Moreover, the support bar arrangement of the various embodiments of the present invention described herein is not limited to diaphragms in any particular section of a turbine. Those skilled in the art will recognize that the support bar arrangement of the various embodiments of the present invention can be applied to all diaphragms of the turbine that include the HP section, IP section and LP section.

Figure 2:
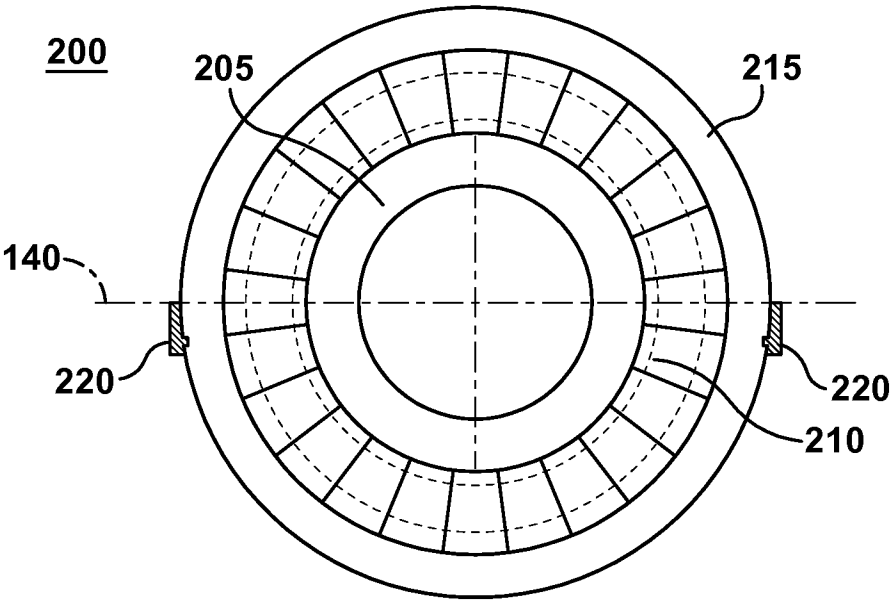
FIG. 2 is a schematic diagram illustrating a front view of a turbine diaphragm having annular diaphragm ring segments joined at a horizontal split surface wherein various embodiments of the present invention may be implemented.

FIG. 2 is a schematic diagram illustrating a front view of a turbine diaphragm 200 such as turbine assemblies 120 and 125 depicted in FIG. 1. As shown in FIG. 2, diaphragm 200 may include an inner web 205, nozzles 210 and an outer ring 215, in which the nozzles 210 are located in the middle between the inner web 205 and the outer ring 215. At least two support bars 220 are secured to each side of the diaphragm outer ring 215 to support the diaphragm 200 vertically at the horizontal joint formed by horizontal split line 140. As described herein, the support bars use at least one fastener, such as for example, a bolt that extends vertically with respect to the outer ring 215 to secure the diaphragm 200 vertically at the horizontal joint. Further detail of the support bars of the various embodiments of the present invention are described below.

Figure 3:
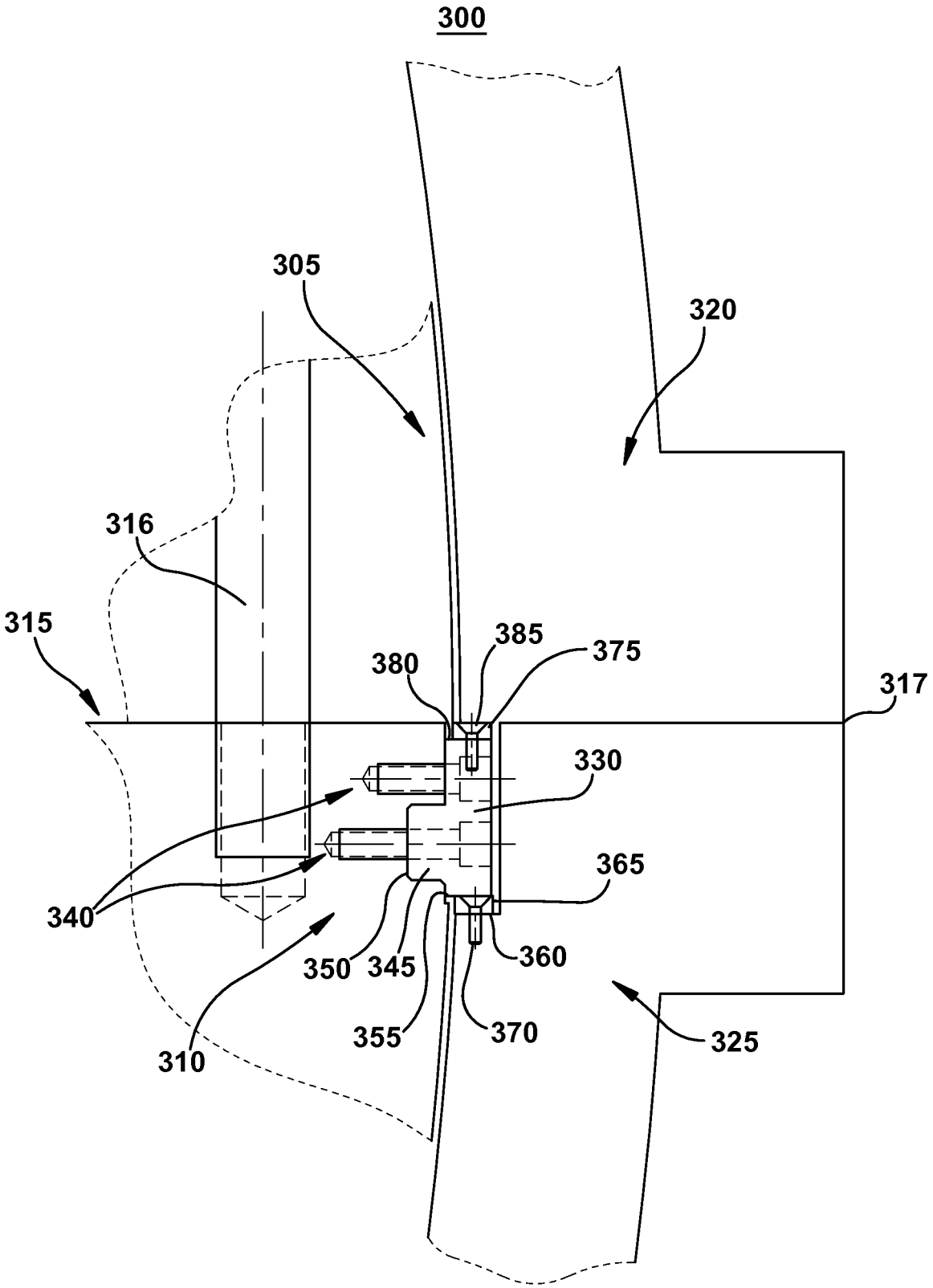
FIG. 3 (Prior Art)
FIG. 3 is a partial end elevation view of a conventional turbine diaphragm support bar arrangement.

FIG. 3 is a partial end elevation view of a conventional turbine diaphragm support bar arrangement 300. The support bar arrangement 300 is used to secure the diaphragm as it is housed within the casing. As shown in FIG. 3, the diaphragm includes an upper diaphragm half 305 and a lower diaphragm half 310 secured together along a horizontal joint 315 by a diaphragm horizontal joint bolt 316. The casing includes an upper casing half 320 and a lower casing half 325 that are divided along a midline 317. A support bar 330 supports the lower diaphragm half 310 within the lower casing half 325. The support bar 330 includes support bar bolt(s) 340 extending through the support bar. As shown in FIG. 3, one of the support bar bolts 340 extends horizontally through a boss 345 that is shown as a horizontal projection that is inwardly directed towards the lower diaphragm half 310 and received by a mating slot 350 formed in the lower diaphragm half. The other support bar bolt 340 extends horizontally from a top portion of the support bar 330 into an opening formed in the lower diaphragm half 310 that is configured to receive the bolt. The support bar 330 as shown in FIG. 3 extends vertically along the lower casing half 325 on one side and the lower diaphragm half 310 on the other side. The support bar 330 has a lower surface 355 that faces a shoulder 360 formed in the lower casing half 325. In particular, the lower surface 355 of the support bar 330 is seated on a lower shim block 365 that is placed between the lower surface and the shoulder 360 of the lower casing half 325. As shown in FIG. 3, a lower shim block bolt 370 may be used to bolt the support bar 330 to the lower casing half 325. A second shim block 375 is shown seated on an upper surface 380 of the support bar 330 to effectively make the upper end of the support bar flush with the horizontal joint surface 315 and midline 317 of the diaphragm and casing halves, respectively, enabling the support bar to be sandwiched between the upper casing half 320 and the lower casing half 320. As shown in FIG. 3, an upper shim block bolt 385 is used to bolt the support bar 330 to the upper casing half 320.

The support bar arrangement 300 illustrated in FIG. 3 has been found herein to be a hindrance when it becomes necessary to perform diaphragm vertical alignment. In particular, diaphragm alignment may take several shifts or days to complete because the rotor and lower half diaphragm has to be removed in order to perform vertical alignment or maintenance on the turbine diaphragm. In the configuration shown in FIG. 3, the support bar 330 and adjustment shim block 365 cannot readily be removed from the lower diaphragm half 310 without removing it from the lower casing half 325, because there is not enough clearance to get to the horizontal support bar bolts 340 that secure to the lower diaphragm half. The fact that the support bar 330 cannot be removed while the lower diaphragm half 310 is housed in the lower casing half 325 prevents the diaphragm from being adjusted vertically. Thus, the rotor needs to be removed to allow removal of the lower diaphragm half 310.

Another issue associated with the support bar arrangement shown in FIG. 3 is that the support bar bolts 340 have a horizontal depth in the lower diaphragm half 310 that is too close to the horizontal joint bolt 316. Having the support bar bolts 340 almost intersect with the horizontal joint bolt 316 in the lower diaphragm half 310 limits the size and location of the diaphragm horizontal joint bolt 316. Again, because there is not enough clearance to get to the horizontal extending support bar bolts 340, the rotor and lower diaphragm half need to be removed in order to remove the support bar bolts and lower shim block, so that the diaphragm can be vertically adjusted.

The various embodiments of the present invention have overcome the issues associated with the support bar arrangement 300 shown in FIG. 3, by replacing the horizontal extending support bar bolts 340 with at least one vertical extending support bar bolt. This new design allows the support bar to be secured to the diaphragm with the vertical bolts in shear versus the traditional horizontal bolts in tension, allowing much easier access to remove the bolt(s) without having to remove the entire diaphragm as well as the rotor. Once the bolt(s) are removed and the diaphragm is slightly lifted, the support bar can be pried off of the diaphragm into a machined pocket in the casing. Then, after one support bar has been removed the lower shim block may be removed and machined for vertical alignment adjustment. This also allows the lower diaphragm half to be rolled out of the casing around the rotor, avoiding the removal of the rotor.

Figure 4:
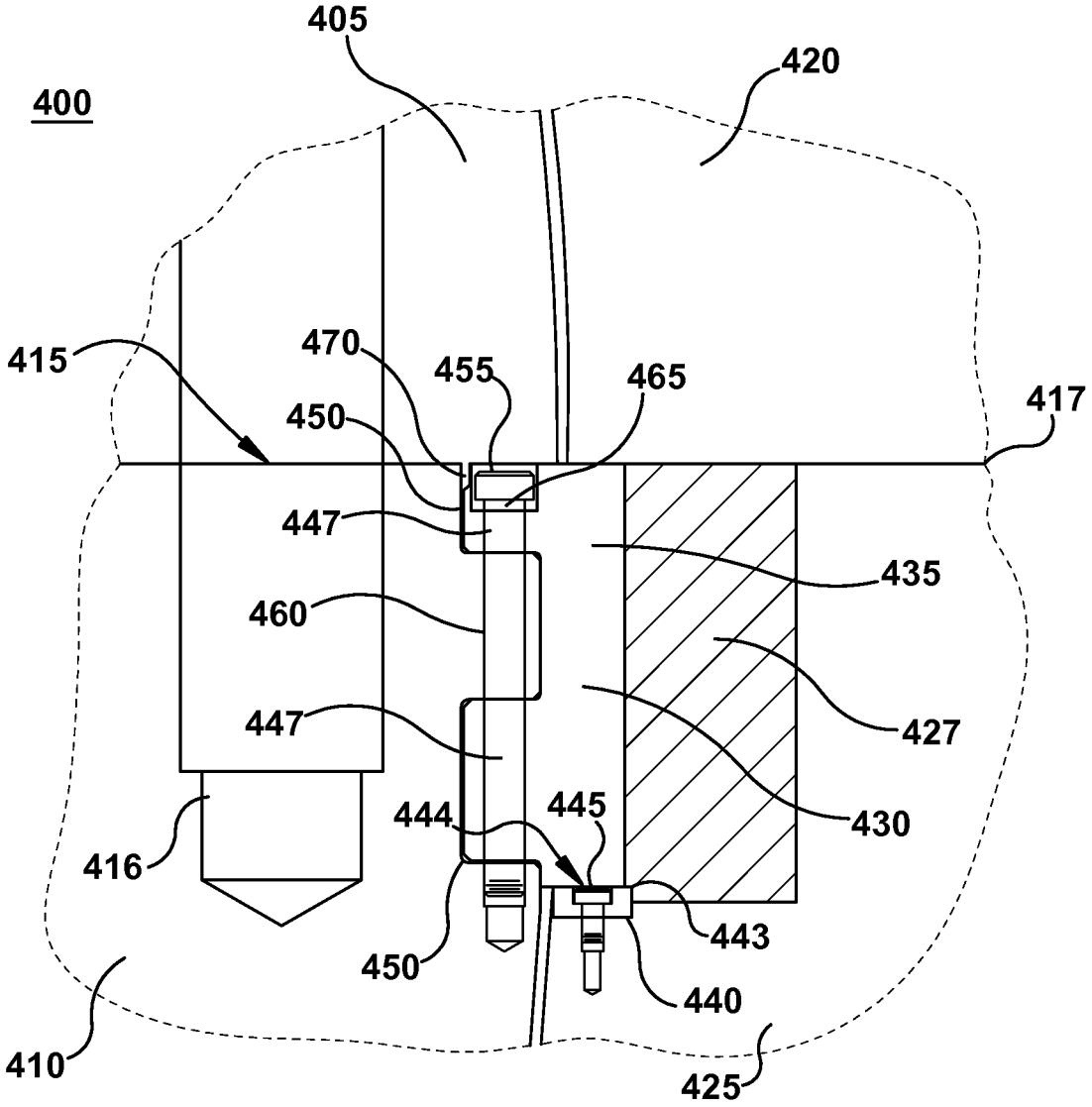
FIG. 4 is a partial end elevation view of a turbine diaphragm support bar arrangement according to one embodiment of the present invention.
Figure 5:
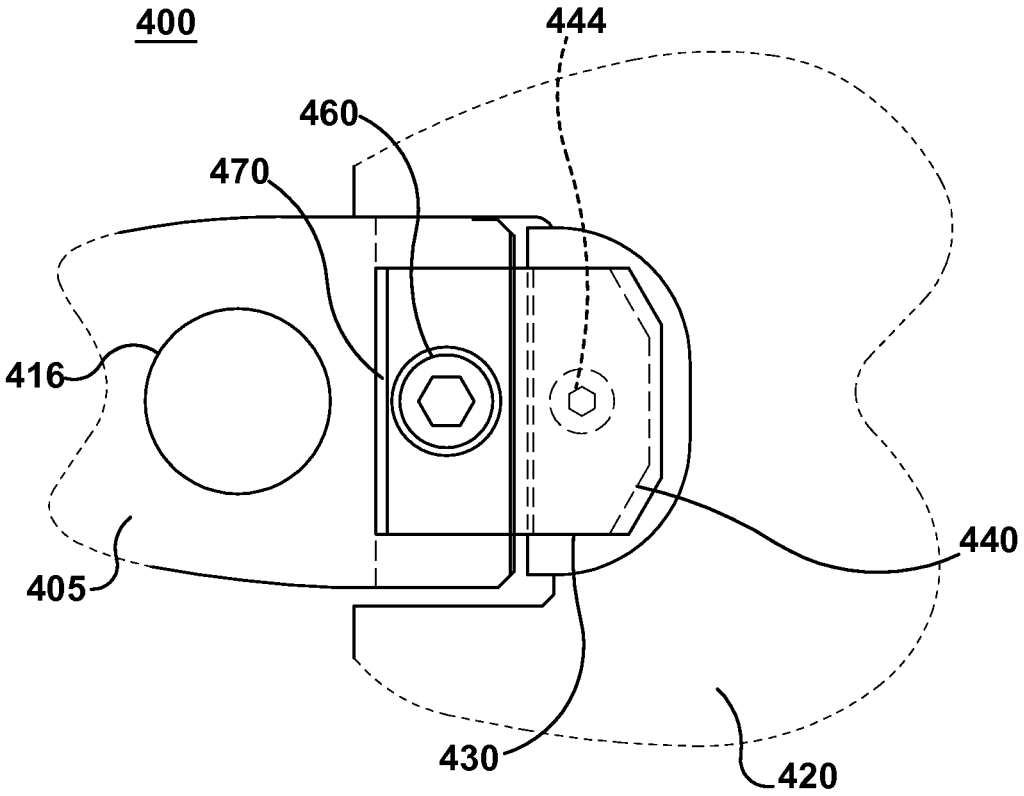
FIG. 5 is a two-dimensional top view of the turbine diaphragm support bar arrangement illustrated in FIG. 4 according to one embodiment of the present invention.

FIGS. 4-5 show a more detailed view of a support bar arrangement 400 for a diaphragm in a casing according to one embodiment of the present invention. In, particular, FIG. 4 shows a partial end elevation view of the support bar arrangement 400, while FIG. 5 shows a two-dimensional top view of the support bar arrangement. Because FIG. 4 shows most of the elements that are associated with the support bar arrangement 400, the following discussion is described with reference to FIG. 4. As shown in FIG. 4, the diaphragm includes an upper diaphragm half 405 and a lower diaphragm half 410 secured together along a horizontal joint 415 by a diaphragm horizontal joint bolt 416. The casing includes an upper casing half 420 and a lower casing half 425 having an extended pocket 427 formed therein. The upper casing half 420 and a lower casing half 425 are divided along a midline 417.

The support bar arrangement 400 as shown in FIG. 4 includes a support bar 430 that supports the lower diaphragm half 410 while housed within the extended pocket 427 of the lower casing half 425. The support bar 430 comprises a vertical body portion 435 having a lower surface seated on the top surface of a lower shim block 440 that is placed between the lower surface and a shoulder 443 of the lower casing half 425 for vertical alignment. In another embodiment, one could also machine the bottom surface of the support bar 430 to achieve the vertical adjustment versus removing the lower shim block 440 for machining. A shim fastener 444 is used to bolt the support bar 430 to the lower casing half 425 through a shim block opening 445 formed therein. As shown in FIG. 4, the shim fastener 444 extends through the shim block opening 445 into the lower casing half 425 securing the shim block 440 thereto. In one embodiment, the shim fastener 444 is a bolt such as a socket-head cap screw that is complementarily threaded with the shim block opening 445 formed in the shim block 440. Although the shim fastener 444 is disclosed as a bolt in one embodiment, those skilled in the art will recognize that other types of fasteners such as a dowel (pin) or a recessed pocket (with no fastener) are suitable for use.

The support bar 430 further includes at least one boss 447 that extends substantially perpendicular from the vertical body portion 435. The at least one boss 447 is adapted to mate in at least one slot 450 formed in the lower diaphragm half 410. In one embodiment of the present invention, the support bar 430 includes two bosses. As shown in FIG. 4, a first boss 447 extends from an upper end of the vertical body portion 435 and a second boss 447 extends from near a lower end of the vertical body portion. The first boss located at the upper end portion of the vertical body portion 435 is separated a predetermined distance apart from the second boss located near the lower end. In this embodiment, the first boss 447 mates in a first slot 450 formed in the lower diaphragm half 410 and the second boss 447 mates in a second slot 450 formed in the lower diaphragm half. In this configuration, the first boss 447 located near the upper end of the vertical body portion 435 is level with respect to the horizontal joint 415 formed between the upper diaphragm half 405 and the lower diaphragm half 410.

As shown in FIG. 4, the at least one boss 447 has at least one support bar opening 455 formed therein that extends therethrough to receive at least one support bar fastener 460 to secure the support bar 430 vertically with the lower diaphragm half 410. The at least one support bar fastener 460 threads into the lower diaphragm half 410. In one embodiment, the at least one support bar fastener 460 is a bolt such as a socket-head cap screw that is complementarily threaded with the at least one support bar opening 455 formed in the at least one boss 447. Although the fastener is disclosed as a bolt in one embodiment, those skilled in the art will recognize that other types of fasteners such as a dowel (pin) or a recessed pocket (with no fastener) are suitable for use with the support bar 430.

FIG. 4 shows that the support bar 430 may have a torque gap 465 formed in the at least one boss 447 in one embodiment. As shown in FIG. 4, the torque gap 465 is formed in the boss 447 that is located below a top portion of the at least one support bar fastener 460. The torque gap 465 is formed underneath the head of the fastener (e.g., bolt) 460 after it has been fastened in the support bar opening 455. The torque gap 465 functions to prevent fastener (e.g., bolt) 460 pre-torque from taking the load off the upper boss 447, which in turn makes the fastener (e.g., bolt) carry the diaphragm stage load. As a result, the lower boss 447 located near the bottom of the support bar 430, can hold the load from the diaphragm by putting the lower boss in shear.

FIG. 4 shows that the support bar 430 may also include a pry groove 470 that is formed in the slot 450 between the at least one boss 447 and a surface of the lower diaphragm half 410 in one embodiment. As shown in FIG. 4, the pry groove 470 is located between the boss 447 in the upper end of the support bar 430 and a surface of the lower diaphragm half 410. The pry groove 470 helps in removing the support bar 430 from the slot 450 formed in the lower diaphragm half 410 during diaphragm vertical adjustment or maintenance. In particular, the pry groove 470 can be used to pry the support bar 430 from the slot 450 formed in the lower diaphragm half 410 after the fastener (e.g., bolt) 460 has been removed.

Figure 6:
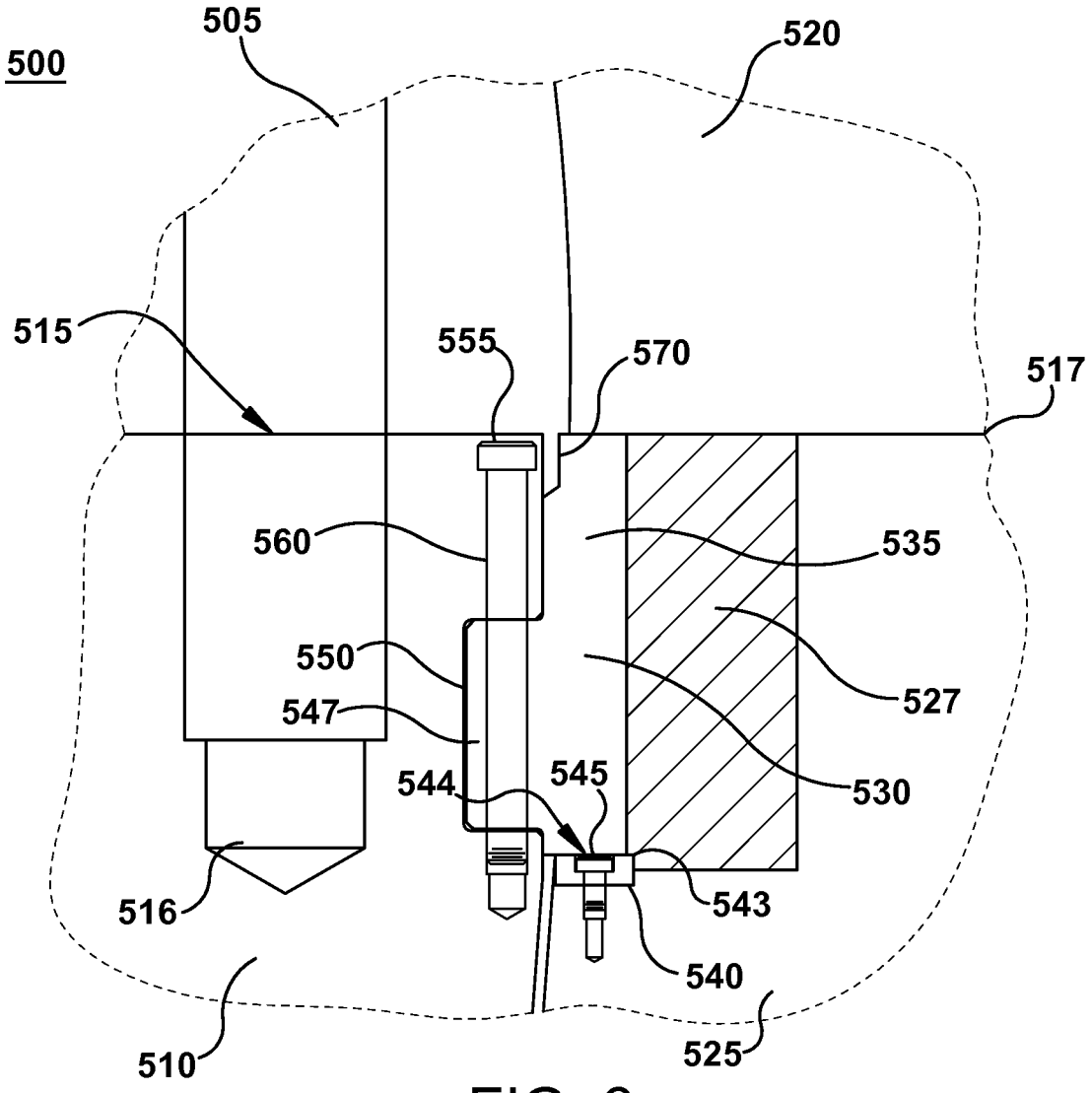
FIG. 6 is a partial end elevation view of a turbine diaphragm support bar arrangement according to another embodiment of the present invention.
Figure 7:
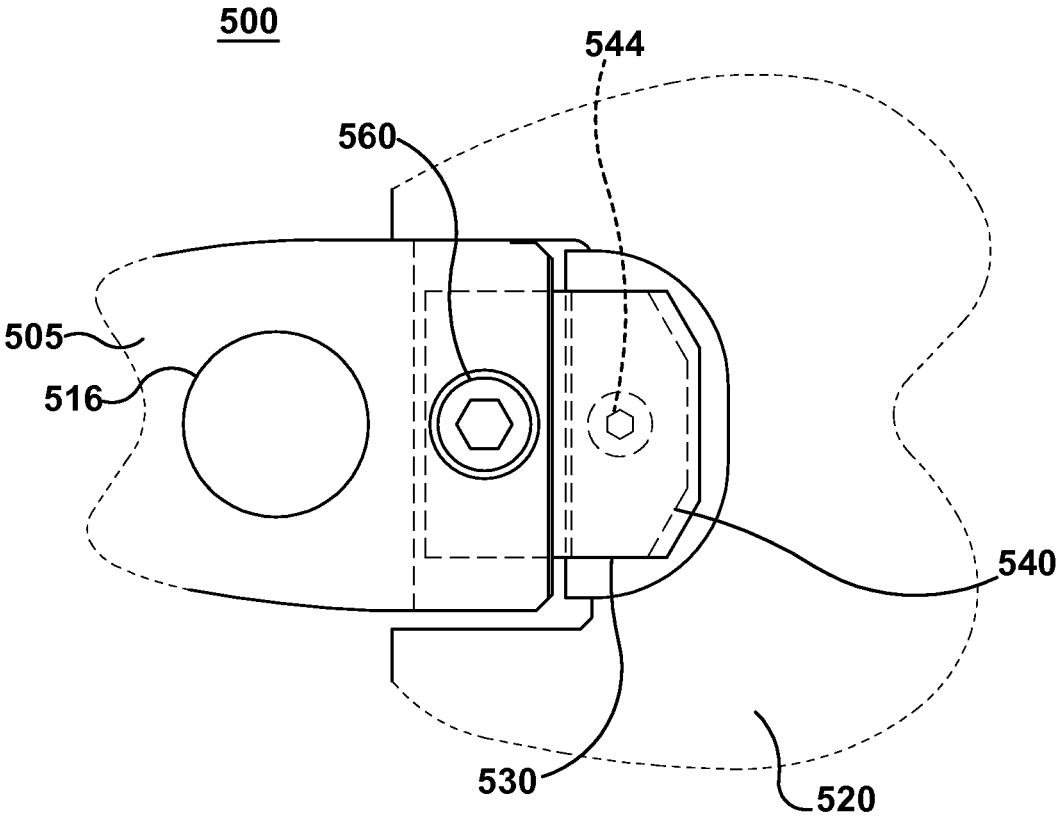
FIG. 7 is a two-dimensional top view of the turbine diaphragm support bar arrangement illustrated in FIG. 6 according to one embodiment of the present invention.

FIGS. 6-7 show a more detailed view of a support bar arrangement 500 for a diaphragm in a casing according to another embodiment of the present invention. In particular, FIG. 6 shows a partial end elevation view of the support bar arrangement 500, while FIG. 7 shows a two-dimensional top view of the support bar arrangement. Because FIG. 6 shows most of the elements that are associated with the support bar arrangement 500, the following discussion is described with reference to FIG. 6. Parts in FIGS. 6-7 that are similar to parts used in FIGS. 4-5 are applied with like reference elements, except that the reference elements used in FIGS. 6-7 are preceded with the numeral "5". Because some of the reference elements in FIGS. 6-7 are similar to the elements described with reference to FIGS. 4-5, a separate discussion is not presented with respect to those elements in the embodiment illustrated in FIGS. 6-7.

The embodiment illustrated in FIGS. 6-7 differs from the embodiment illustrated in FIGS. 4-5 in that there is only one boss 547 used in the support bar 530 that slides into the slot 550 of the lower diaphragm half 510. As shown in FIG. 6, the boss 547 is located near a lower end of the vertical body portion 535 in order to hold the load from the diaphragm by putting the boss in shear. In this embodiment, the boss 547 is spaced upwardly away from the lower surface of the vertical body portion 535. In addition, the boss 547 in this embodiment has an extended height as compared to the embodiment illustrated in FIG. 5, in order to prevent rotation of the support bar 530 due to moment forces on the boss 547.

Another distinction of the embodiment illustrated in FIGS. 6-7 with respect to the embodiment illustrated in FIGS. 4-5 is that the optional pry groove 570 may be formed between the top portion of the bar fastener (e., bolt) 560 and a surface of the support bar 530 that faces the lower diaphragm half 510. Again, the pry groove 570 functions to help remove the support bar 530 from the slot 550 formed in the lower diaphragm half 510 during diaphragm maintenance.

As mentioned above, the cycle time and cost of performing diaphragm vertical alignment adjustment or maintenance on the diaphragm will be reduced by using one of the support bar arrangements 400 and 500 because each configuration obviates the need to remove the rotor and lower diaphragm half. In either configuration, maintenance begins by first removing the upper casing half and upper diaphragm half in normal fashion. Next, the lower diaphragm half is slightly lifted to alleviate friction between the support bars and the shim blocks. The support bar fastener from one support bar is then removed vertically, and then the support bar is pried off the diaphragm. Then the lower shim block is removed for machining to adjust the vertical diaphragm position as needed. It is also possible to remove the lower diaphragm half by rolling it out the opposite side of the removed support bar around the rotor. For re-assembly the reverse of the above process is used. Because both configurations may use existing shim block designs, diaphragm lifting procedures, and horizontal joint bolting designs, there need only be slight machining modifications to the casing and diaphragm that are within the purview of those skilled in the art to make the embodiments of the present invention feasible.

While the disclosure has been particularly shown and described in conjunction with a preferred embodiment thereof, it will be appreciated that variations and modifications will occur to those skilled in the art. Therefore, it is to be understood that the appended claims are intended to cover all such modifications and changes as fall within the true spirit of the disclosure.

What is claimed is:

1. A support bar for a turbine diaphragm, comprising:

a vertical body portion having at least one boss extending substantially perpendicular from the vertical body portion, wherein the at least one boss comprises a first boss that extends from an upper end of the vertical body portion and a second boss that extends from near a lower end of the vertical body portion, the first boss separated a predetermined distance apart from the second boss, the first boss and second boss each adapted to mate in a respective slot formed in the turbine diaphragm, the first and second boss each having at least one opening formed therein that extends vertically therethrough, the at least one opening formed in the first boss and second boss each adapted to receive a fastener that extends through both the first boss and the second boss to secure the vertical body portion and both the first boss and the second boss vertically with the turbine diaphragm.

2. The support bar according to claim 1, wherein the first boss is level with respect to a horizontal joint formed between an upper half and a lower half of the diaphragm.

3. The support bar according to claim 1, wherein the fastener comprises a bolt that is complementarily threaded with the at least one opening.

4. The support bar according to claim 3, wherein the bolt threads into the diaphragm.

5. The support bar according to claim 1, wherein the first boss and the second boss each extend a length radially inward from the vertical body portion that is substantially the same.

6. A support bar arrangement for a turbine diaphragm in a turbine casing, the turbine diaphragm having an upper diaphragm half and a lower diaphragm half with at least one slot formed therein, the upper diaphragm half and lower diaphragm half secured together along a horizontal joint, the turbine casing having an upper casing half and a lower casing half having a shoulder formed therein, the upper casing half and lower casing half secured together along a midline, the support bar arrangement comprising:

a shim block having a lower surface and a top surface, the lower surface of the shim block seated on the shoulder of the lower casing half;

a support bar comprising a vertical body portion having a lower surface seated on the top surface of the shim block and at least one boss extending substantially perpendicular from the vertical body portion, wherein the at least one boss comprises a first boss that extends from an upper end of the vertical body portion and a second boss that extends from near a lower end of the vertical body portion, the first boss separated a predetermined distance apart from the second boss, the first boss and second boss each adapted to mate in a slot formed in the lower diaphragm half, the first and second boss each having at least one support bar opening formed therein; and a support bar fastener that extends through the at least one support bar opening in both the first boss and the second boss to secure the support bar vertically with the lower diaphragm half.

7. The support bar arrangement according to claim 6, wherein the first boss is level with respect to the horizontal joint formed between the upper diaphragm half and the lower diaphragm half.

8. The support arrangement according to claim 6, comprising a torque gap formed in the first boss below a top portion of the support bar fastener.

9. The support bar arrangement according to claim 6, comprising a pry groove formed in between the top portion of the support bar fastener and a surface of the lower diaphragm half.

10. The support bar arrangement according to claim 6, wherein the support bar fastener comprises a bolt that is complementarily threaded with the at least one support bar opening.

11. The support bar arrangement according to claim 10, wherein the bolt threads into the lower diaphragm half.

12. The support bar arrangement according to claim 6, wherein the shim block comprises a shim block opening formed therein and configured for use in vertical adjustment of the turbine diaphragm.

13. The support bar arrangement according to claim 12, further comprising a shim fastener that extends through the shim block opening into the lower casing half securing the shim block thereto.

14. The support bar arrangement according to claim 6, wherein the first boss and the second boss each extend a length radially inward from the vertical body portion that is substantially the same.

15. A steam turbine, comprising:

a turbine diaphragm having an upper diaphragm half and a lower diaphragm half with at least one slot formed therein, the upper diaphragm half and lower diaphragm half secured together along a horizontal joint;

a turbine casing that houses the turbine diaphragm, the turbine casing having an upper casing half and a lower casing half having a shoulder formed therein, the upper casing half and lower casing half secured together along a midline;

a support bar that supports the turbine diaphragm while housed in the turbine casing, the support bar comprising a vertical body portion having at least one boss extending substantially perpendicular from the vertical body portion, wherein the at least one boss comprises a first boss that extends from an upper end of the vertical body portion and a second boss that extends from near a lower end of the vertical body portion, the first boss separated a predetermined distance apart from the second boss, the first boss and second boss each adapted to mate in a slot formed in the lower diaphragm half, the first and second boss each having at least one support bar opening formed therein; and a support bar fastener that extends through the support bar opening in both the first boss and the second boss to secure the support bar vertically with the lower diaphragm half.

16. The steam turbine according to claim 15, further comprising a shim block having a lower surface and a top surface, the lower surface of the shim block seated on the shoulder of the lower casing half and the upper surface of the shim block has the support bar seated thereon.

17. The steam turbine according to claim 15, wherein the at least one support bar fastener comprises a bolt that threads with the at least one support bar opening.

18. The steam turbine according to claim 15, wherein the first boss and the second boss each extend a length radially inward from the vertical body portion that is substantially the same.

* * * * *